US006343627B1

(12) United States Patent
Hasaka et al.

(10) Patent No.: US 6,343,627 B1
(45) Date of Patent: Feb. 5, 2002

(54) FEED DEVICE FOR LARGE AMOUNT OF SEMICONDUCTOR PROCESS GAS

(75) Inventors: Satoshi Hasaka; Kenji Shigeta; Takashi Kuroiwa; Tomoaki Hoshi; Hideki Seki; Toshiyuki Aida, all of Tokyo (JP)

(73) Assignee: Nippon Sanso Corporation, Tokyo (JP)

( * ) Notice: Subject to any disclaimer, the term of this patent is extended or adjusted under 35 U.S.C. 154(b) by 0 days.

(21) Appl. No.: 09/530,630

(22) PCT Filed: Aug. 31, 1999

(86) PCT No.: PCT/JP99/04701

§ 371 Date: May 3, 2000

§ 102(e) Date: May 3, 2000

(87) PCT Pub. No.: WO00/14782

PCT Pub. Date: Mar. 16, 2000

(30) Foreign Application Priority Data

Sep. 3, 1998 (JP) ..... 10-250089
Apr. 23, 1999 (JP) ..... 11-116448

(51) Int. Cl.[7] ..... B65B 31/00
(52) U.S. Cl. ..... 141/18
(58) Field of Search ..... 141/3, 18; 222/3; 137/614.21

(56) References Cited

U.S. PATENT DOCUMENTS 4,989,160 A * 1/1991 Garrett et al. ..... 364/509
5,113,905 A * 5/1992 Pruitt et al. ..... 137/571
5,810,031 A * 9/1998 Evans et al. ..... 137/557
6,076,359 A * 6/2000 Jurcik et al. ..... 62/50.2

FOREIGN PATENT DOCUMENTS

| | | |
|---|---|---|
| JP | 1-307299 | 12/1989 |
| JP | 5-68866 | 3/1993 |
| JP | 10-30798 | 2/1998 |

* cited by examiner

*Primary Examiner*—Gregory L. Huson
*Assistant Examiner*—Peter deVore
(74) *Attorney, Agent, or Firm*—Armstrong, Westerman, Hattori, McLeland & Naughton, LLP

(57) ABSTRACT

An apparatus for supplying a semiconductor process gas charged in a large-capacity gas vessel to a plant where the gas is used, after reduction of the pressure of the gas. The gas cylinder 21 is composed essentially of a cylindrical portion 22 and hemispherical portions 23 and 24 formed at the ends of the cylindrical portion respectively. The gas cylinder 21 has a gas charge port 26 at one hemispherical portion and a gas discharge port 27 at the other hemispherical portion both of which opening in alignment with the axis 25 of the cylindrical portion 22. A charge valve 28 and a gas discharge unit 29 having at least a gas vessel valve 30 and a pressure reducing valve 32 are connected to the gas charge port and the gas discharge port respectively. The gas cylinder 21 is housed together with the charge valve 28 and the gas discharge unit 29 in a container 36.

6 Claims, 8 Drawing Sheets

FEED DEVICE FOR LARGE AMOUNT OF SEMICONDUCTOR PROCESS GAS

TECHNICAL FIELD

The present invention relates to an apparatus for mass-supplying a semiconductor process gas, more specifically to an apparatus for mass-supplying a semiconductor process gas which supplies a semiconductor manufacturing process gas such as monogermane, monosilane, disilane, diborane, arsine, phosphine, hydrogen selenide, hydrogen chloride, hydrogen bromide, silicon tetrachloride, nitrogen trifluoride, methane tetrafluoride, ethane hexafluoride, dinitrogen monoxide, sulfur hexafluoride and ammonia in a large amount safely using a compact system.

BACKGROUND ART

The quantity of semiconductor process gases employed in the semiconductor industries is increasing with the increase in the number of wafers treated per plant, and a further increase is estimated in treatment of 300 mm (12 inch) wafers. Further, most of semiconductor process gases or fluid generally have combustibility, toxicity and corrosive properties. Those gases having particularly high combustibility and high toxicity such as monogermane, monosilane, disilane, diborane, arsine, phosphine and hydrogen selenide are special high-pressure gases which should satisfy requirements in terms of technique and equipment defined by the safety standard under the law, self-imposed control, etc. Under such circumstances, maintenance of safety is now the essential factor. With an impending necessity of mass supply of semiconductor process gases with the increase in the diameter of wafers, these gases need to satisfy safety requirements more strictly.

Higher quality is required in semiconductor process gases as devices are more and more refined, and particularly reduction of moisture, oxygen and oxygen compounds, as well as metal impurities and particles, which are decisive factors for device failure, is strictly demanded.

Usually, semiconductor process gases are charged in high-pressure vessels (cylinders) in gas charging plants, and the cylinders are loaded on autotrucks and transported to semiconductor manufacturing plants where they are stored temporalily in high-pressure gas storages for semiconductor process gases. When a semiconductor process gas is to be consumed, the high-pressure cylinder is housed in a cylinder cabinet so as to secure safety, and then the gas charged in the cylinder is supplied to a semiconductor processing apparatus.

In the case where a semiconductor process gas is supplied using an ordinary bomb or cylinder having a capacity of 47 liters or less, a gas cylinder valve attached to the cylinder is connected to a pressure reducing valve located in the cylinder cabinet, and the gas is subjected to pressure reduction before it is supplied to a semiconductor processing apparatus. Meanwhile, the cylinder cabinet is provided with a purge gas cylinder, a purge gas line and a detoxicating unit for the semiconductor process gas and has a structure such that the atmospheric air components migrating thereto during replacement of the gas cylinder or a purge gas can be replaced with the semiconductor process gas. The cylinder cabinet is also provided with an alarm capable of detecting gas leakage in the cylinder and a gas supply line for maintenance of safety. A main valve of the gas cylinder is originally equipped with an emergency shut-off function or an emergency shut-off valve is located in addition to the main valve so as to shut off supply of the gas in case of detection of any gas leakage. Usually, the gas in the cylinder cabinet is normally exhausted, and the cylinder cabinet has a mechanism for achieving detoxication of a leak gas with the aid of a scrubber and detoxicating unit connected to the cylinder cabinet.

When a semiconductor process gas is supplied in a large amount, the so-called bundled system having several tens of ordinary 47-liter cylinders bundled into one unit or the loader system having an assembly of 5 to 20 cylinders with an outside diameter of 300 mm or more (particularly 350 to 400 mm) and a length of 1.5 m to 12 m is employed. Thus, it is actually impossible to house ≧47-liter cylinders in the cylinder cabinet. Therefore, a large cylinder is located outdoors so as to cope with mass supply of a semiconductor process gas, and a gas supply panel containing a pressure reducing valve is disposed adjacent to the cylinder so that the gas is supplied through this panel.

FIG. 1 shows a schematic drawing explaining the bundled system gas supply apparatus. In this apparatus, ten 47-liter cylinders 10 are connected by a manifold 12 via cylinder valves 11 and are housed together in a frame 13. The manifold 12 is connected by a joint 20 via a valve 14 and a pipe 15 to a pipe 19, having a pressure reducing valve 17 and a closing valve 18, in a gas receiving equipment 16 installed in a plant where the gas is used. Two bundled system gas supply apparatuses are arranged in the plant and are used selectively. Accordingly, the upstream side and the downstream side of the pressure reducing valve 17 constitute a high-pressure gas region H and a low pressure gas region L respectively.

However, the conventional semiconductor process gases are frequently charged in cylinders at the pressure of not less than 1 Mpa. In the gas supply method resorting to such gas supply apparatus, there is a long distance between the cylinders 10 and the gas receiving equipment 16, so that the piping through which the high-pressure gas flows without pressure reduction is long, and that maintenance of safety becomes that much severe and difficult. Thus, the distance of the piping in the high-pressure gas region H connecting the manifold 12 with the pressure reducing valve 17 ranges over several tens of meters, and the high-pressure gas is as such allowed to flow through the piping laid over a long distance in a semiconductor plant.

Further, since the manifold 12 is connected at many joints with the gas cylinder valves 11 of the cylinders, the liability of leakage increases. In other words, factors dominating safety in terms of handling of semiconductor process gases are decided depending on the length of the high-pressure gas region H and the number of sections where leakage can occur (e.g., fitting) in supplying a semiconductor process gas.

Further, semiconductor process gases to be supplied are required to have high purity so as to maintain product quality. The quality of a semiconductor process gas depends on whether purging of atmospheric air components during cylinder replacement is achieved well or not. Meanwhile, the semiconductor process gas reacts, on metal surfaces to be brought into contact with the gas, with moisture adsorbed thereon or oxygen or undergoes autolysis to form corrosion products or by-products. Thus, the state of gas contact surfaces changes with elapse of time, and the amount of adsorbed water, the amount of intruded oxygen and particle count which cause pollution in the piping during cylinder replacement also change, so that the conditions of purging the atmospheric air components are caused to change inevitably. Since it takes much time for purging the atmospheric air components, and since it is impossible to estimate whether the atmospheric air components are fully removed or not even if much time is spent for the purging, it happens occasionally that the atmospheric air component moisture and oxygen, or particles cause pollution in the semiconductor processing apparatus; or that the semiconductor process gas reacts with the moisture and oxygen to form oxygen compounds, particles, in turn, corrosion products, and such by-products cause pollution in the semiconductor processing apparatus, to be causative of deterioration of electric performance of the resulting devices and reduction in the yield.

DISCLOSURE OF THE INVENTION

It is a first objective of the present invention to provide a gas supply apparatus which has a reduced installation space and can cope with use of a mass of gas.

It is a second objective of the present invention to enhance purging performance of the gas supply system and to prevent entry of impurities into the processing apparatus so as to supply a high-purity semiconductor process gas which is used in a large amount safely and without reduction in the purity thereof.

It is a third objective of the present invention to realize a gas supplying cylinder equipment which facilitates safety control and can maintain safety by reducing the section filled with a high-pressure gas (high-pressure gas region) where gas leakage is likely to occur to reduce the liability of leakage and by reducing the space for pipes in the gas supply line and joints therein.

In the apparatus for supplying a semiconductor process gas charged in a large-capacity gas cylinder to a plant where the gas is used after reduction of the pressure of the gas according to the present invention, the gas cylinder is composed essentially of a cylindrical portion and hemispherical portions formed at the ends of the cylindrical portion respectively. The gas cylinder also has a gas charge port at one hemispherical portion and a gas discharge port at the other hemispherical portion, so that the ports open in alignment with the axis of the cylindrical portion. A charge valve and a gas discharge unit having at least a gas cylinder valve and a pressure reducing valve are connected to the gas charge port and the gas discharge port respectively. The gas cylinder is housed together with the charge valve and the gas discharge unit in a container.

Since the high-pressure section is reduced by connecting the gas discharge unit having a gas cylinder valve and a pressure reducing valve to the gas discharge port which is a high-pressure gas section where gas leakage is likely to occur, and since the gas cylinder is housed together with the charge valve and the gas discharge unit in the container, high security can be maintained against gas leakage and the like even if a large-capacity gas cylinder is used. In addition, if two pressure reducing valves are arranged in series in the gas discharge unit, two-step pressure reduction can be implemented.

The mass supply apparatus is provided with at least one selected from an alarm for detecting gas leakage in the container; exhaust means for exhausting the gas in the container; and a purge gas cylinder charged with a purge gas for effecting purging in the gas discharge unit. A gas supply unit is connected to the gas discharge unit outside the container. The gas supply unit contains a supply valve connected on the downstream side to a piping of the plant where the gas is used, a purge gas inlet passage and an analysis gas outlet passage connected to the upstream side of the supply valve. The mass supply apparatus is provided with at least one selected from a detector for analyzing impurities contained in a gas to be purged out when the gas discharge unit is connected to the gas supply unit; and a detoxicating column for detoxicating the gas to be exhausted by the purging before the gas discharge unit is separated from the gas supply unit. In the mass supply apparatus, a plurality of containers can be selectively connected to one gas supply unit.

The footprint of the gas supply apparatus in a semiconductor plant where the gas is used can be minimized by connecting a plurality of containers selectively to a gas supply unit.

BEST MODE FOR CARRYING OUT THE INVENTION

Figure 1:
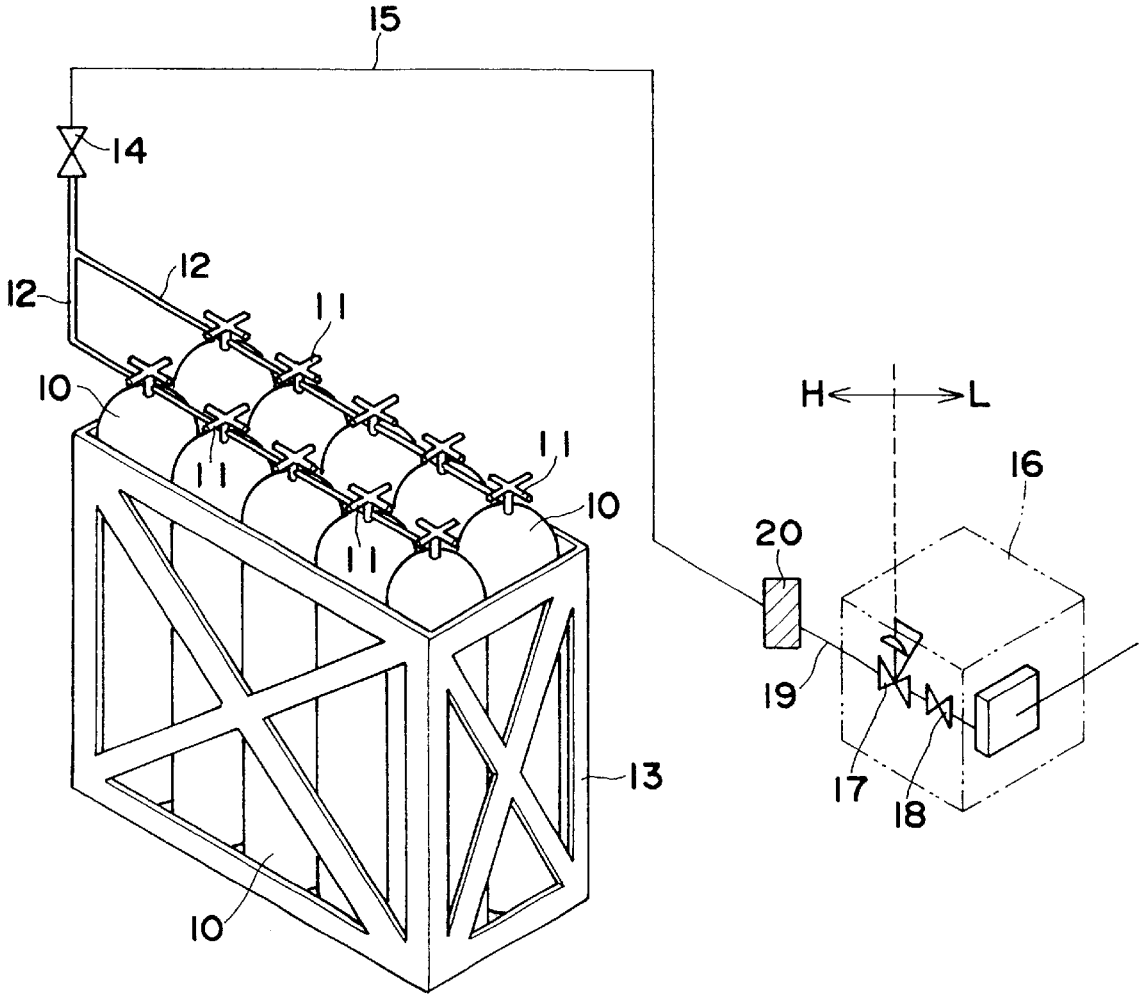
FIG. 1 is a schematic diagram for explaining the conventional bundled system gas supply apparatus.

Embodiments of the apparatuses and units according to the present invention will be described specifically referring to FIGS. 2 to 9. In the embodiments shown in the drawings, the same and like elements are affixed with the same reference numbers respectively.

Figure 2:
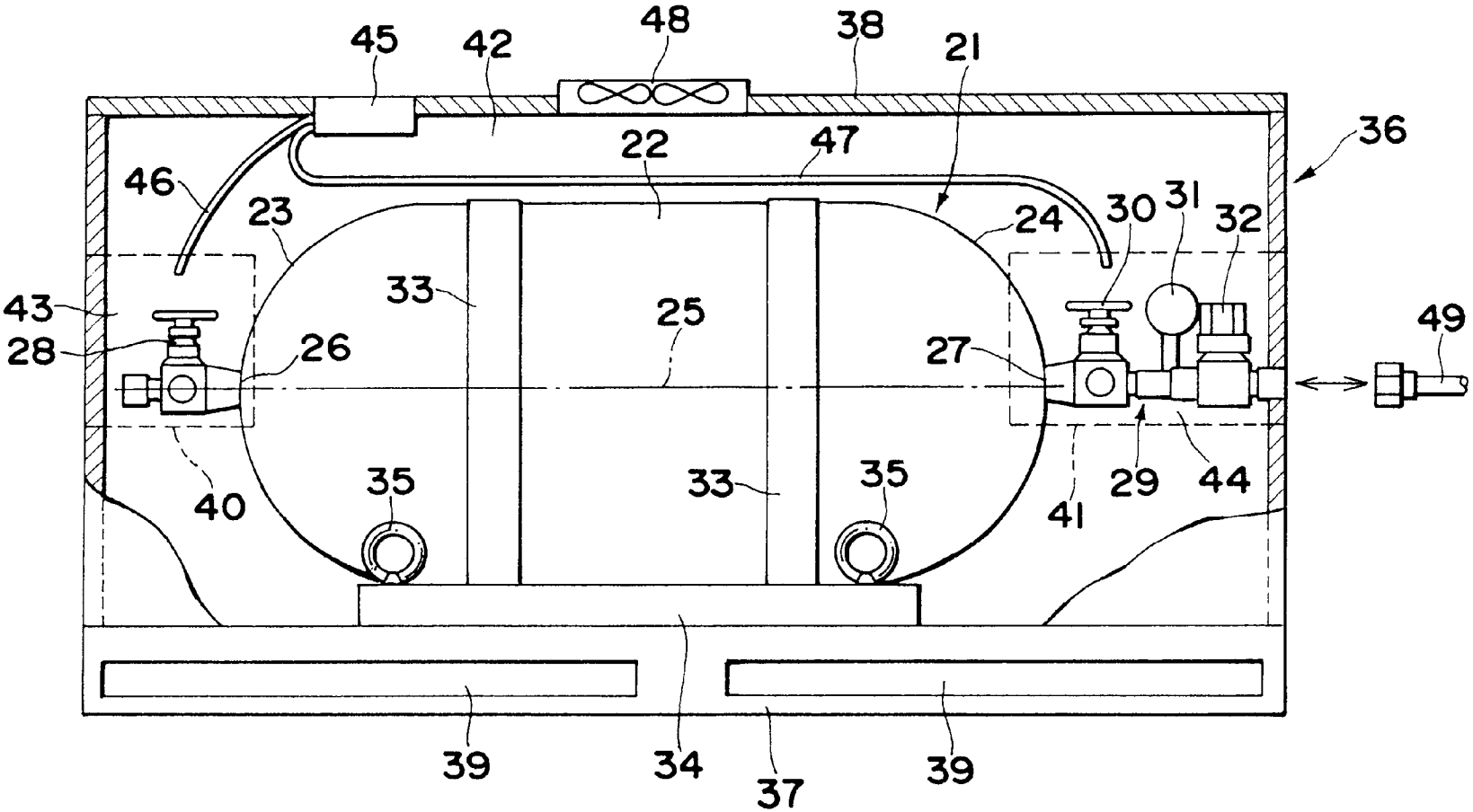
FIG. 2 is a schematic diagram showing the apparatus for mass-supplying a semiconductor process gas according to a first embodiment of the present invention.
Figure 3:
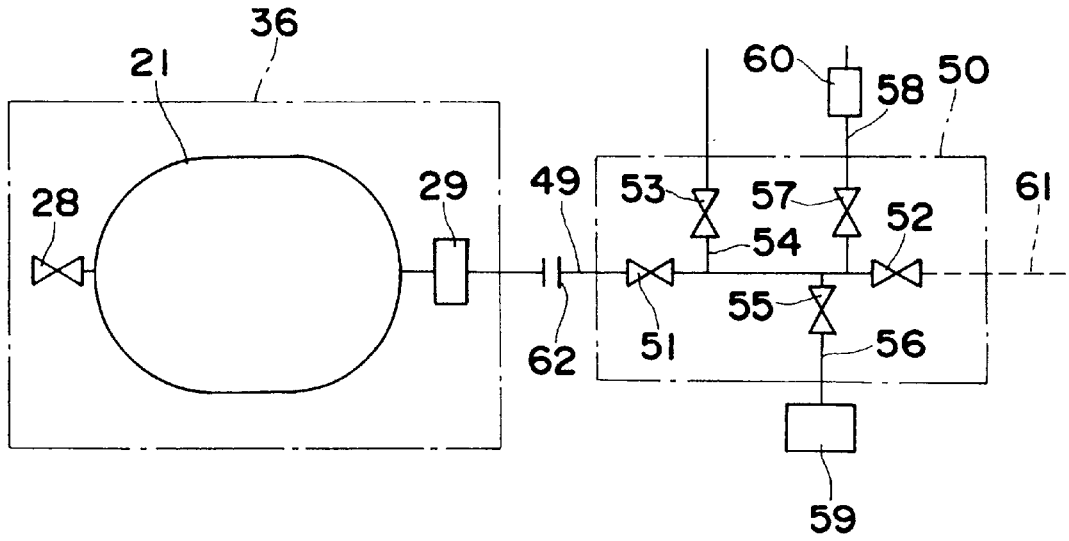
FIG. 3 is a system diagram showing how the gas discharge unit and the gas supply unit in the first embodiment are connected to each other.

The apparatus for mass-supplying a semiconductor process gas (or mass-supply apparatus) according to a first embodiment of the present invention will be described referring to FIGS. 2 and 3. A gas cylinder 21 is composed essentially of a cylindrical portion 22 and a hemispherical portion 23 and 24 formed at the ends of the cylindrical portion 22 respectively. The gas cylinder 21 has at the hemispherical portion 23 a gas charge port 26 and at the other hemispherical portion 24 a gas discharge port 27. The gas charge port 26 and the gas discharge port 27 are opening in alignment with the axis 25 of the cylindrical portion 22. A charge valve 28 is connected to the gas charge port 26. A gas discharge unit 29 is connected to the gas discharge port 27. The gas discharge unit 29 is composed essentially of a gas cylinder valve 30, a pressure gauge 31 and a pressure reducing valve 32 which are connected in series.

The gas cylinder 21 can be fabricated using a material such as SUS steel, CrMo steel, carbon steel, Mn steel, Al alloy and reinforced plastics with Al lining. The gas cylinder 21 in this embodiment has dimensions of 600 mm (outside diameter)×2200 mm (length) and a capacity of about 470 liters. However, the gas cylinder 21 can be designed suitably depending on the semiconductor manufacturing scale and fabricated into a size to be suitably disposed in a semiconductor plant: outside diameter, in the range of 300 mm to 1200 mm; length, in the range of 1500 mm to 12000 mm.

Gases to be charged into the gas cylinder 21 are semiconductor process gases including $SiH_4$, $AsH_3$, $PH_3$, $SF_6$, $NF_3$, $CF_4$, $C_2F_6$, $CH_4$, HF, HCl, HBr, $ClF_3$, $NH_3$, $N_2O$, $SiCl_4$, He, $H_2$, $O_2$, $CO_2$ and CO.

It is preferred on the standpoint of safety to dispose the gas cylinder valve 30 and the pressure reducing valve 32 close to each other, since gas replacement characteristics can be improved on a wide margin and the portion in the piping to be exposed to high pressure can be reduced. Further, the gas cylinder valve 30 and the pressure reducing valve 32 may be disposed in the form of so-called block valve formed by integrating them into one block. Block valves employable here include triple three-way valves and quadruple four-way valves. These valves are fabricated by forging, for example, brass, stainless steel or nickel alloy, followed by machining. A spring type or diaphragm type valve is suitably used as the pressure reducing valve 32. While a pressure gauge 31 such as of bourdon tube type, strain gauge type and diaphragm type semiconductor gauge can be suitably used as the pressure gauge 31 for confirming the charge pressure of the gas to be charged into the gas cylinder 21, the diaphragm type semiconductor gauge is particularly preferred as the pressure gauge. Further, a thermometer such as a sheath type thermocouple for measuring the temperature of the supply gas may be attached to the gas discharge unit 29.

The gas cylinder 21 is laid on the barrel and is immobilized on a mount 34 by a pair of bands 33. Four hanger rings 35 are attached to the upper surface of the mount 34 at each corner.

The mount 34 having the gas cylinder 21 laid thereon is placed on a baseplate 37 of a container 36, and thus the gas cylinder 21 is housed in the container 36 together with the charge valve 28 and the gas discharge unit 29. The container 36 has a cover 38 which can be opened and closed by sliding means and the like. Meanwhile, forking slits 39 are formed in the baseplate 37 so as to facilitate lifting and transportation of the container 36 by a fork lift truck. Further, as the container 36, a box or a nissen hut-like container can be used. Further, the container 36 may, as necessary, has a door or a shutter for external operation so as to enable operations of connecting connection pipes and the like such as manifold to the gas discharge unit 29.

The internal space of the container 36 is divided by a partition 40 surrounding the charge valve 28 and by a partition 41 surrounding the gas discharge unit 29 into a gas cylinder installation space 42, a charge valve installation space 43 and a gas discharge unit installation space 44. Gas sampling Synflex tubes 46 and 47 extending from a leak alarm 45 are inserted to the charge valve installation space 43 and the gas discharge unit installation space 44 respectively so as to monitor constantly whether there is any gas leakage or not in these two spaces 43 and 44. An exhaust fan 48 is attached to the cover 38 of the container 36. Vents (not shown) are formed in the partitions 40 and 41 so as to blow out the gas leaked into the space in the container 36. The gas exhausted by the exhaust fan 48 is detoxicated by a detoxicator and then released into the atmosphere. Here, as the exhaust means, an exhaust duct can be used in place of the exhaust fan. It is preferred to attach detoxicating columns to the vents of the partitions 40 and 41.

Since the gas discharge unit 29 and the exhaust fan 48 are operated interlocking with the alarm 45, supply of the gas is stopped and the exhaust fan 48 is driven if the alarm 45 detects any leakage, thus improving safety. Means for burying an detoxicating agent directly in the container 36 or detoxicating means packed with a detoxicating agent may be located in the container 36 so as to achieve detoxication in case of gas leakage into the gas cylinder installation space 42. Detoxicating agents employable here include, for example, diatomaceous earth impregnated with ferric chloride and a catalyst component, a silica or alumina carrier impregnated with potassium permanganate or caustic soda, an activated carbon doped with a catalyst component such as an alkali and a metal oxide, and a metal oxide molded merely into a granule. It should be noted here that the detoxicating agent shall not be exposed normally to the ambient air, and it can exhibit higher detoxicating effects over a longer period. Accordingly, it is preferred to construct a system in which the exhaust fan 48 is interlocked with the alarm 45 to be driven only when the alarm 45 is actuated, and the gas leaked into the container 36 is exhausted via the detoxicating means to the atmosphere under the suction force of the exhaust fan.

When the gas in the gas cylinder 21 is purged, the gas charge port 26 is utilized as a purge gas inlet port, while the gas discharge port 27 is utilized as a purge gas outlet. The gas cylinder 21, the charge valve 28, the gas discharge unit 29 and the pipings are subjected on the gas contact surfaces to surface polishing, for example, mechanical polishing, abrasive polishing, electrolytic polishing, composite electrolytic polishing, chemical polishing and composite chemical polishing or to electroless plating or electroplating with Ni so as to minimize the amount of moisture and gas molecules or particles adsorbed onto such surfaces with which the flow of gas is brought into contact and to improve corrosion resistance of the metal surfaces. Further, a fluorine passivation film may be formed on the Ni-coated surface. In the case where the above elements are made of stainless steel, a passivation oxide film of, for example, iron or chromium may be formed by heat treatment after the surface polishing treatment.

The surface roughness (R) of the internal wall of the gas cylinder 21 is suitably Rmax 25 $\mu$m or less, preferably Rmax 12 $\mu$m or less. The surface roughness of the internal walls of the elements constituting the gas discharge unit 29, the piping and the like are desirably 1 $\mu$m or less, preferably 0.5 $\mu$m or less.

The gas discharge unit 29 is connected on the external side of the container 36 to a gas supply piping 49 which is connected to a gas supply unit 50 of a semiconductor manufacturing plant (not shown). The semiconductor process gas charged in the gas cylinder 21 is depressurized through the gas discharge unit 29 and is supplied from the gas supply pipe 49 through the gas supply unit 50 to the semiconductor manufacturing plant.

In the gas supply unit 50, an inlet valve 51 and a supply valve 52 are connected in series, and a purge gas inlet pipe 54 having a purge gas inlet valve 53, an exhaust pipe 56 having an exhaust valve 55 and an analysis pipe 58 having a sampling valve 57 are connected to the upstream side of the supply valve 52. The exhaust pipe 56 is connected to a detoxicating column 59 for removing harmful components contained in the gas being purged. The analysis pipe 58 is connected to a detector 60 for analyzing impurities such as moisture, oxygen and particles contained in the gas being purged. The supply valve 52 is connected on the downstream side to a pipe 61 of the plant where the gas is used. This gas supply unit 50 and the gas discharge unit 29 are connected to each other detachably by a connecting section 62.

In this mass-supply apparatus, a purge gas is introduced through the purge gas inlet pipe 54 into the gas supply unit 50 when the gas discharge unit 29 is connected to the gas supply unit 50 to effect purging of the upstream side of the supply valve 52. The moisture concentration and oxygen concentration in the purge exhaust gas are determined successively, and upon dropping of these concentrations to 10 ppb or lower, the supply of the purge gas is stopped. Subsequently, the semiconductor process gas is withdrawn from the gas cylinder 21 to effect purging of the gas supply unit 50 likewise with the process gas via the gas discharge unit 29. It should be noted here that prior to this purging with the process gas, the gas discharge unit 29 and the piping, the gas supply unit 50, pipe fitting, etc. locating on the downstream side of the unit 29 are preferably evacuated to a pressure of several Torr or less via the piping 49 from a gas receiving equipment in the plant where the gas is used.

The purge gas and the semiconductor process gas used for the purging are detoxicated in the detoxicating column 59 and then exhausted. Meanwhile, in order to supply a semiconductor process gas to the semiconductor manufacturing plant, it is preferred to repeat at least 5 times the cycle of purging with the semiconductor process gas and evacuation. As the detector 60 for judging the end point of purging, a moisture meter for analyzing moisture contained in the gas (e.g., a crystal oscillation Ba-coated moisture meter), an oxygen meter for analyzing presence of impurities such as oxygen (e.g., a galvanic cell type oxygen meter) or a particle counter is as necessary used suitably.

According to the apparatus for mass-supplying a semiconductor process gas having the constitution as described above, the cylinder cabinet used in the prior art becomes unnecessary. In addition, this apparatus has a simple structure compared with the bundled system, the investment on gas cylinders can be substantially halved.

Figure 4:
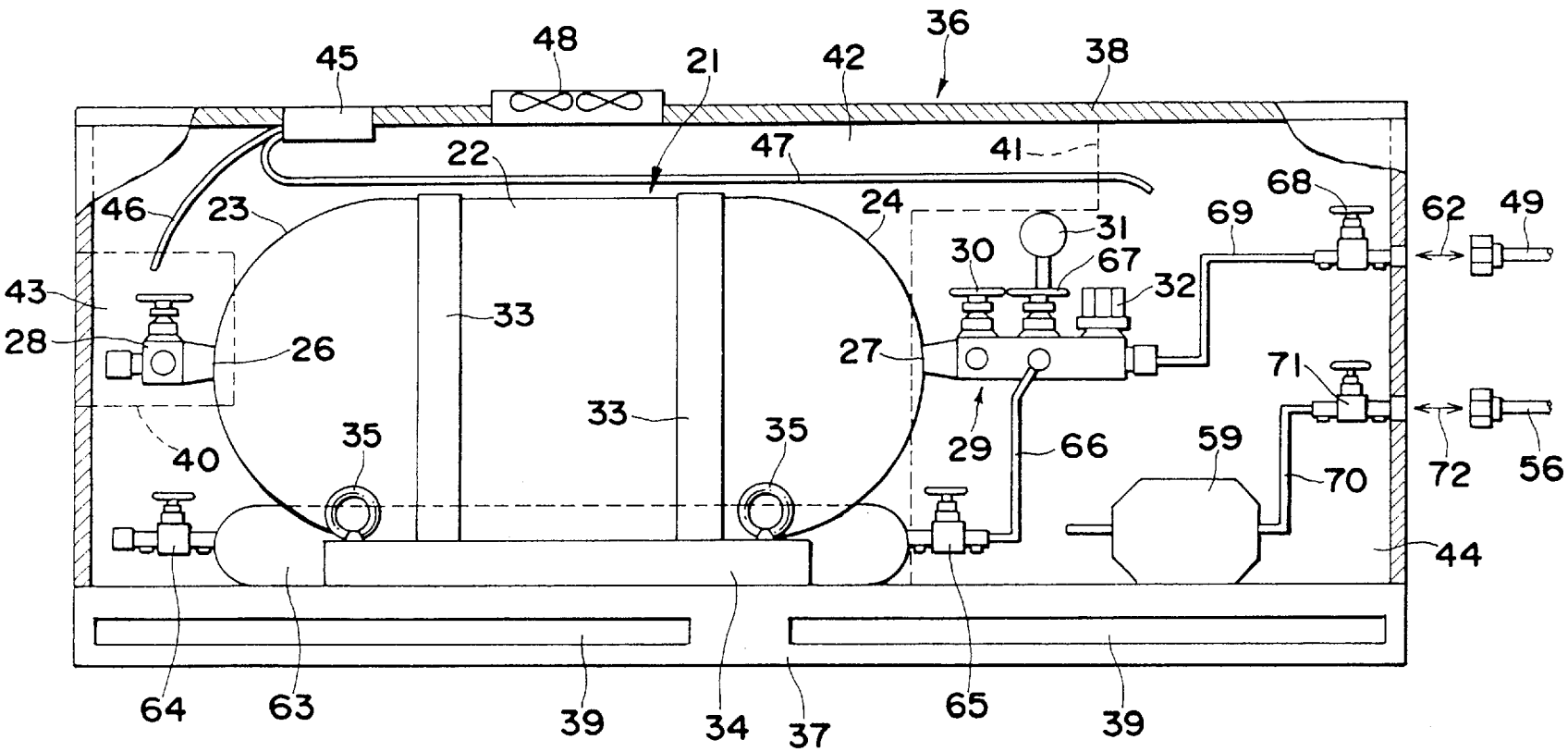
FIG. 4 is a schematic diagram showing the apparatus for mass-supplying a semiconductor process gas according to a second embodiment of the present invention.
Figure 5:
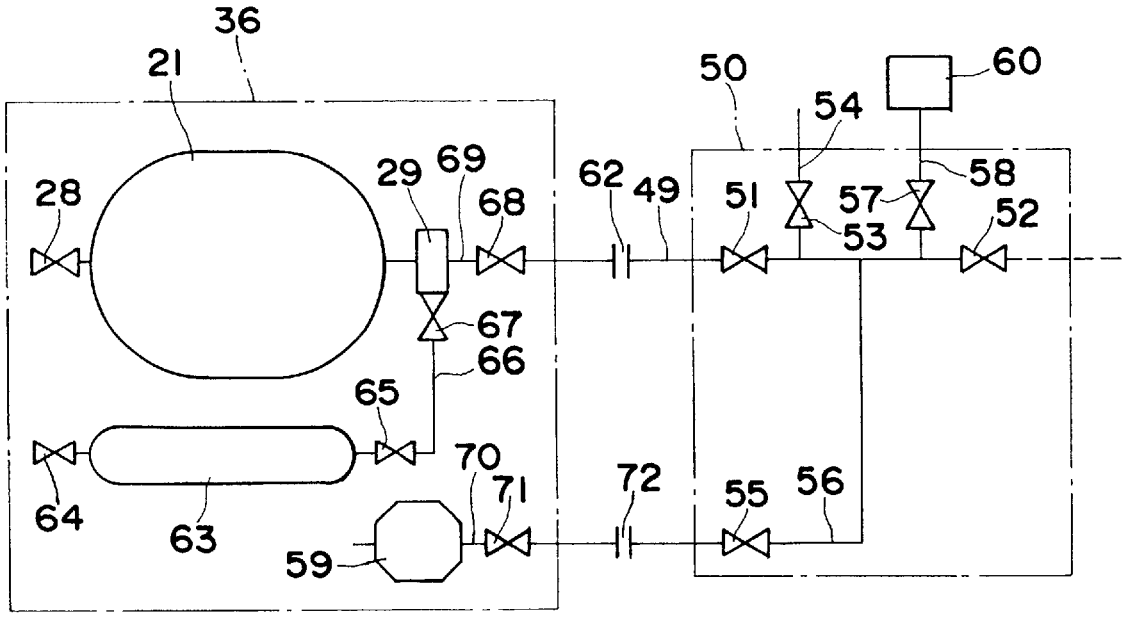
FIG. 5 is a system diagram showing how the gas discharge unit and the gas supply unit in the second embodiment are connected to each other.

Next, the apparatus for mass-supplying a semiconductor process gas according to a second embodiment of the present invention will be described referring to FIGS. 4 and 5. This embodiment is directed to providing an apparatus for mass-supplying a semiconductor process gas, which guarantees supply of a gas with a higher purity by connecting a purge gas cylinder 63 disposed in a container 36 to a gas discharge unit 29 and to a gas supply unit 50.

The purge gas cylinder 63 has a gas charge valve 64 and a gas cylinder valve 65 attached at one end and at the other end thereof respectively, and a purge gas supply pipe 66 is connected to the gas cylinder valve 65. This purge gas cylinder 63 may be a general gas cylinder, and, for example, a Mn steel cylinder having a capacity of 10 liters and the like can be used. The purge gas cylinder 63 is charged with a purging inert gas, for example, high-purity nitrogen gas having a water content of 5 ppb or less and a pressure of 14.7 Mpa.

The purge gas supply pipe 66 is connected to a purge gas valve 67 of the gas discharge unit 29. The purge gas valve 67 is located between the gas cylinder valve 30 and the pressure reducing valve 32. In this unit 29, a triple three-way block valve integrated with these three valves 30, 32 and 67 is preferably used to reduce the liability to leakage, entry of impurity, etc. The gas discharge unit 29 is connected via a discharge pipe 69 having an outlet valve 68 to the gas supply piping 49.

The detoxicating column 59 is disposed in the container 36. An exhaust gas inlet pipe 70 is connected to the detoxicating column 59, and the inlet pipe 70 is connected via an inlet valve 71 to the exhaust pipe 56. The exhaust gas inlet pipe 70 and the exhaust pipe 56 are detachably connected to each other by a connecting section 72.

In this mass-supply apparatus, when the gas discharge unit 29 is connected to the gas supply unit 50, a purge gas is introduced through the purge gas supply pipe 66 to the gas discharge unit 29 to effect purging of the downstream side of the gas cylinder valve 30. The purge gas is also introduced through the purge gas inlet pipe 54 to the gas supply unit 50 to effect purging of the upstream side of the supply valve 52.

In the mass-supply apparatus of the second embodiment, since the number of pipes to be exposed to the ambient air is reduced by disposing in the container 36 the purge gas cylinder 63 together with the gas cylinder 21 for semiconductor processing, purging efficiency is improved, and the moisture concentration and oxygen concentration can be reduced to 10 ppb or lower in 1.5 hours, which is about half as much as the time required in the conventional apparatus (3 hours). Installation of the detoxicating column 59 in the container 36 enables detoxication treatment of process gases and eliminates the necessity of installing a detoxicating equipment in each gas receiving equipment in a plant where the gas is used, thus saving the facility cost in the gas receiving equipment.

Figure 6:
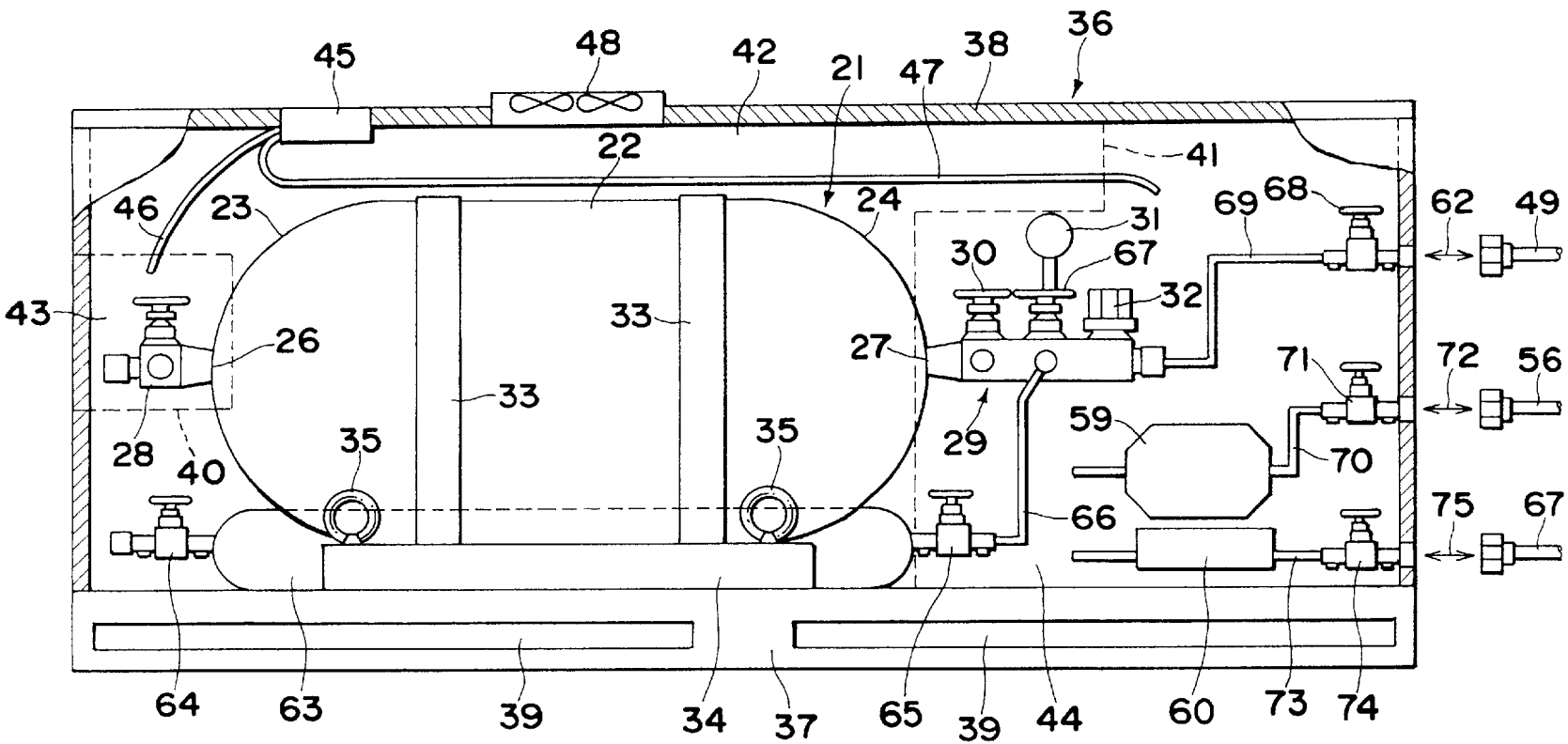
FIG. 6 is a schematic diagram showing the apparatus for mass-supplying a semiconductor process gas according to a third embodiment of the present invention.
Figure 7:
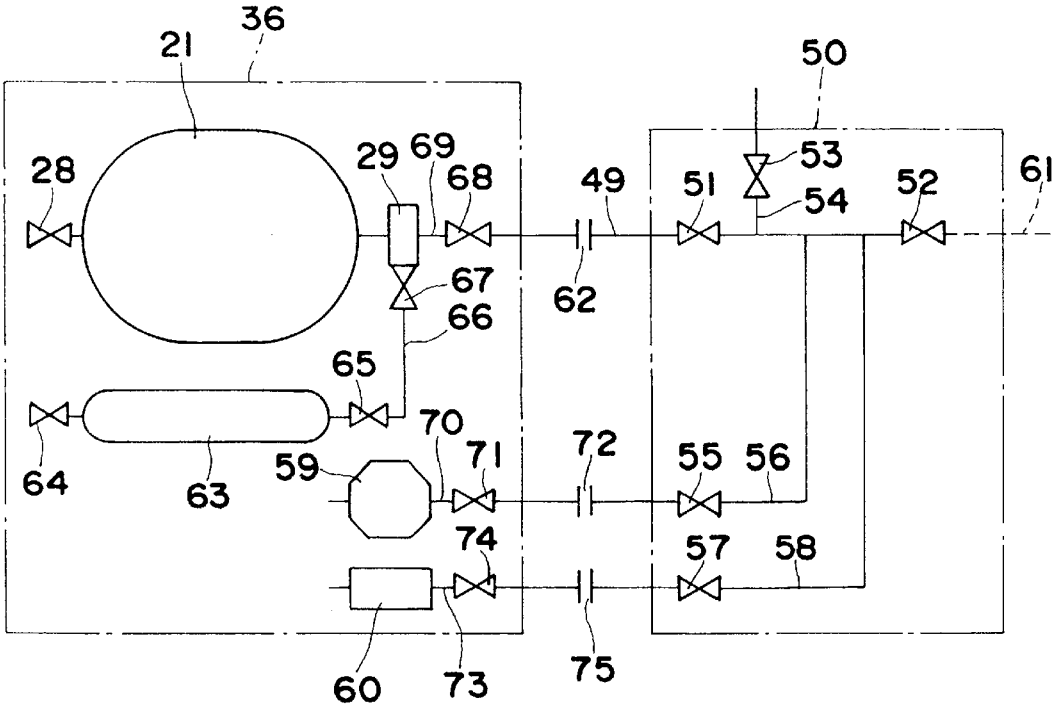
FIG. 7 is a system diagram showing how the gas discharge unit and the gas supply unit in the third embodiment are connected to each other.

Next, the apparatus for mass-supplying a semiconductor process gas according to a third embodiment of the present invention will be described referring to FIGS. 6 and 7. The mass-supply apparatus of this embodiment is the same as that of the second embodiment except that the detector 60 is disposed in the container 36 so as to decide an appropriate end point of purging. To this detector 60 is connected a sampling gas exhaust pipe 73 which is connected through an inlet valve 74 to the analysis pipe 58. This sampling gas exhaust pipe 73 and the analysis pipe 58 are connected to each other detachably by a connecting section 75.

For example, in the case where $SiH_4$ is used as a semiconductor process gas, if moisture remains in the equipment including piping, the residual moisture or oxygen reacts with $SiH_4$ to form $SiO_2$ powder to cause clogging of the equipment and seat leak troubles. However, since the mass-supply apparatus of the third embodiment is provided with detectors such as a moisture meter and an oxygen meter, it enables by itself supply of a high-purity semiconductor process gas to a plant where it is used in a substantially perfect state as can be used satisfactory as such.

Next, a mass-supply apparatus according to the third embodiment of the present invention was fabricated as specified below and was compared with a conventional mass-supply apparatus.

| | |
|---|---|
| Apparatus of the present invention | |
| Semiconductor process gas cylinder 21 | |
| Capacity: | 470 liters |
| Dimensions: | 600 mm (outside diameter) |
| | 2200 mm (length) |
| Dimensions of the container 36 | |
| | 2500 mm (length) |
| | 800 mm (width) |
| | 800 mm (height) |

-continued

| | |
|---|---|
| Conventional apparatus<br>Gas cylinder used in the conventional bundled system | |
| Capacity: | 47-liter/cylinder |
| Number of cylinders integrated: | 10 |
| Total capacity: | 470 liters |
| Space necessary for integration of 10 gas cylinders: | |
| | 2000 mm (length)<br>1200 mm (width)<br>1800 mm (height) |
| Dimensions of frame necessary for integration of cylinders into a bundled: | |
| | 2500 mm (length)<br>2000 mm (width)<br>1800 mm (height) |

Comparative Examination

Footprint:

[2500 mm (length)×800 mm (width)]/[2500 mm (length)×2000 mm (width)]=0.4

The footprint of the apparatus of the present invention was approximately 40% of that of the conventional apparatus.

Occupancy volume:

[2500 mm (length)×800 mm (width)×800 mm (height)]/[(2500 mm (length)×2000 mm (width)×1800 mm (height))=0.17

The occupancy volume of the apparatus of the present invention was 17% of that of the conventional apparatus.

Figure 8:
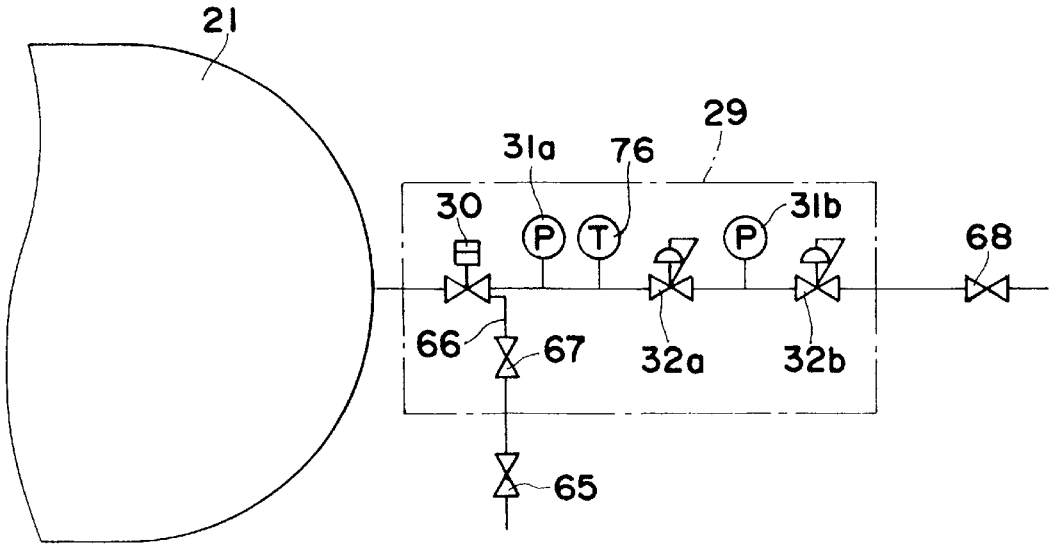
FIG. 8 is a system diagram showing one embodiment of the gas discharge unit for achieving two-step pressure reduction.

Next, an embodiment of the gas discharge unit 29 for two-step pressure reduction will be described referring to FIG. 8. The gas discharge unit 29 constitutes a valve block structure obtained by connecting in series a gas cylinder valve 30, a first pressure gauge 31*a*, a temperature sensor 76, a first pressure reducing valve 32*a*, a second pressure gauge 31b and a second pressure reducing valve 32*b* and also connecting a purge gas supply pipe 66 having a purge gas valve 67 to the downstream side of the cylinder valve 30.

The body of the valve block constituting this gas discharge unit 29 can be obtained by machining brass, stainless steel, nickel alloy, etc. While the cylinder valve 30 is generally of the keyplate type or diaphragm type, the diaphragm type cylinder valve is preferred since it has less dead space in the valve and can implement purging efficiently. Meanwhile, PCTFE (polychlorotrifluoroethylene), PFA (perfluoroalkoxyfluoroplastics such as tetrafluoroethyleneperfluororovinyl ether copolymer), polyimide or the like is used for a seat material of the gas cylinder valve 30. Further, referring to driving of opening and closing of the gas cylinder valve 30, while a manual valve conventionally used can be utilized, it is preferred to use an air operating valve, since the gas cylinder valve serves also as an emergency shut-off valve. Further, a particle removing filter may be installed on the downstream side of the gas cylinder valve 30. Meanwhile, the pressure reducing valves 32*a* and 32*b* are generally of the spring type. However, it is preferred to employ a diaphragm type pressure reducing valve structure which has less dead space and forms less particles.

Gas contact surfaces of the gas discharge unit 29 are preferably subjected to mechanical polishing, abrasive polishing, electrolytic polishing, composite electrolytic polishing, chemical polishing, composite chemical polishing, etc. or to electrolytic or electroless Ni plating. It is also possible to form Ni fluoride by fluorination treatment on such surfaces. Meanwhile, in the case where the body of the unit 29 is made of a stainless steel, gas contact surfaces of the unit 29 may be subjected to heat treatment after the polishing treatment and form passivation films with oxide films of Fe or Cr. These internal surfaces preferably have a surface roughness of Rmax 1 μm or less, preferably Rmax 0.5 μm or less. A relief valve may be attached either to the gas charge port 26 or to the gas discharge port 27, and this satisfies the legal obligation.

Further, the pressure gauges 31*a* and 31*b* and the temperature sensor 76 can be positioned suitably in the gas discharge unit 29. For example, if the first pressure gauge 31*a* is located on the upstream side of the first pressure reducing valve 32*a*, the internal pressure of the gas cylinder can be detected by opening the gas cylinder valve 30; whereas if the second pressure gauge 31*b* is located on the downstream side of the second pressure reducing valve 32*b*, the feed pressure can be detected.

Such pressure gauges and temperature sensors may be installed as necessary. That is, either the pressure gauge or the temperature sensor may be installed and may be on the high-pressure side or on the low-pressure side, or may be at a medium pressure section. Meanwhile, the pressure gauges employable here include preferably those of bourdon tube type, strain gauge type and semiconductor sensor type. On the standpoint of minimization of dead space, the diaphragm semiconductor sensor type pressure gauges are more preferred. A sheath type thermocouple is suitably used as the temperature sensor.

As described above, high-pressure gas sealed sections can be reduced by forming a gas discharge unit having various valves integrated into a valve block. In addition, pressure reducing valves which were conventionally installed in a gas supply panel can be integrated into the gas cylinder valve, so that the space for piping of the gas supply panel can also be reduced. Besides, the high-pressure gas in the gas cylinder is adapted to be subjected to two-step pressure reduction in the first pressure reducing valve 32*a* and the second pressure reducing valve 32*b* before it is supplied, the temperature of the gas subjected to pressure reduction in these pressure reducing valves is prevented from dropping due to the Joule-Thomson expansion effect. For example, in the case where $N_2$ gas with a charge pressure of 14.7 MPa is subjected to pressure reduction, the gas temperature drops by about 28° C. by one-step pressure reduction to 0.7 MPa as a service pressure. Meanwhile if pressure reduction is implemented in the first step to 5.0 MPa and in the second step to 0.7 MPa, such temperature drops can be portioned so that the temperature drops by about 17° C. and by about 11° C. in the first step and in the second step respectively, and thus drop of the gas temperature can be improved by about 10° C. with the aid of the heat penetrating from the body.

While the degree of reduced pressure in the first pressure reducing valve 32*a* and that in the second pressure reducing valve 32*b* (pressure reduction ratio) can be set suitably depending on the charge pressure and the service pressure, pressure reduction is generally carried out in the first step to 5.0 MPa to 1.0 MPa by the first pressure reducing valve 32*a* and in the second step to 1.0 MPa to 0.1 MPa, which is an ordinary supply pressure, by the second pressure reducing valve 32*b*. When the difference in pressure is great, the pressure can be reduced successively by arranging three or more pressure reducing valves in series, whereas when the difference in pressure is small, one pressure reducing valve is enough.

Further, it is preferred to form gas contact surfaces in the gas supply unit 50 such that impurities hardly adhere thereto like in the gas discharge unit 29 and to use valves and the like having least dead spaces and can achieve purging efficiently.

Next, there is exemplified a case where $SiH_4$ charged with a charge pressure of 7.6 MPa into the gas cylinder 21 is supplied therefrom after pressure reduction to 0.7 MPa using a two-step pressure-reduction type gas discharge unit 29.

The $SiH_4$ gas charged in the gas cylinder 21 is introduced to the two-step pressure-reduction type gas discharge unit 29 by opening the gas cylinder valve 30. After measurement of the pressure of the gas by the first pressure gauge 31*a* and of the temperature thereof in the temperature sensor 76, the gas is introduced to the first pressure reducing valve 32*a*. In the first pressure reducing valve 32*a*, the pressure of the gas is reduced to 1.5 MPa from 7.6 MPa. Pressure control failure in the first pressure reducing valve 31*a* can be detected by measuring the intermediate pressure by the second pressure gauge 31*b*. The gas reduced to the intermediate pressure is then subjected to pressure control by the second pressure reducing valve 31*b* to 0.7 MPa as a service pressure and is supplied to a plant where the semiconductor process gas is used.

It was found as a result of evaluation of the quality of the $SiH_4$ gas supplied according to this method that the count of $\geqq 0.1$-$\mu$m particles was 100/liter, the moisture was not more than 100 pbb and siloxane presumably formed by the presence of water was not more than 200 pbb.

Meanwhile, in the case where the conventional gas cylinder valves and the conventional gas supply panel were used, the quality of the $SiH_4$ gas supplied through the pressure reducing valves in the gas supply panel after evacuation from the gas panel side over 2 hours from cylinder replacement was as follows:

count of $\geqq 0.1$ $\mu$m particles: 10000/liter moisture: $\leqq 100$ ppb siloxane concentration: $\leqq 1$ ppm As described above, according to this two-step pressure-reduction type gas discharge unit 29, since atmospheric air components in the system can be purged out efficiently, and since the process gas having went through the first second pressure reducing valve 32*a* and the second pressure reducing valve 32*b* to have a low pressure is supplied to the gas supply unit 50, security of the system can be improved on a wide margin.

Figure 9:
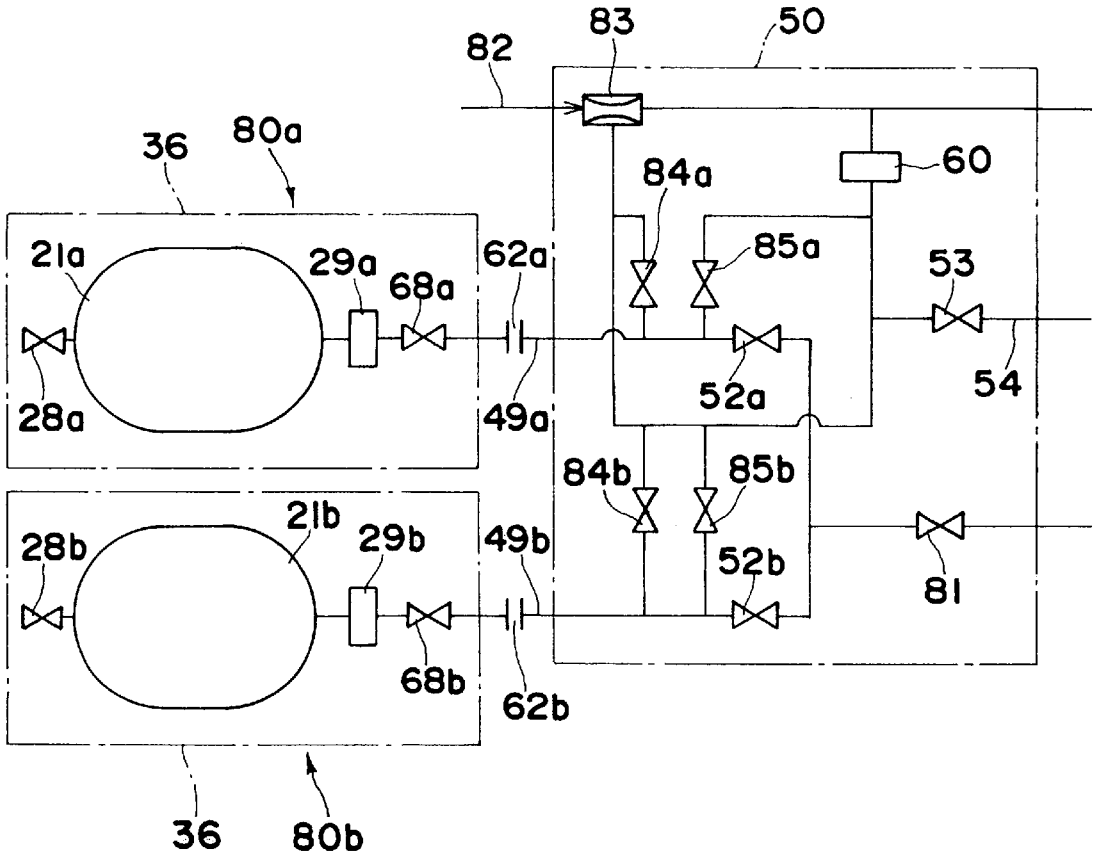
FIG. 9 is a system diagram showing a gas supply unit to which two containers are selectively connected.

Next, there is described an embodiment where two gas cylinder units are connected to one gas supply unit referring to FIG. 9. It should be noted here that the same and like components as in the above embodiment are affixed with the same reference numbers and marks (a, b) respectively.

Gas cylinder units 80*a* and 80*b* each have in a container 36 a gas cylinder 21*a* or 21*b* and units, valves piping, etc. to be connected thereto. When a gas is supplied from the gas cylinder 21*a* connected to a connecting section 62*a*, the supply valve 52*a* and the supply valve 52*b* are opened and closed respectively, and the gas reduced to a predetermined pressure in a gas discharge unit 29*a* flows through an outlet valve 68*a* into a gas supply unit 50 and is supplied through a supply valve 52*a* and a supply main valve 81 to a plant where the gas is used.

When the amount of the gas in the gas cylinder 21*a* decreases to a predetermined level or less, the source of gas is changed over to the cylinder unit 80*b*. The supply valve 52*a* and the supply valve 52*b* are closed and opened respectively by this change-over operation to start immediately supply of the gas from the standby gas cylinder 21*b*.

The gas cylinder unit 80*a* after the change over is replaced as follows. First, a gas is supplied to an exhaust pipe 82 to start a vacuum generator 83, and an exhaust valve 84*a* is opened to exhaust the semiconductor process gas (e.g., $SiH_4$ gas) from the system. Next, a purge gas inlet valve 53 and a selector valve 85*a* are opened to introduce a purge gas (e.g. a high-purity nitrogen gas) into the system to dilute the semiconductor process gas remaining in the system.

Further, the operation of closing the selector valve 85*a* and opening the exhaust valve 84*a* to exhaust the diluted semiconductor process gas and the operation of closing the exhaust valve 84*a* and opening the selector valve 85*a* to introduce a purge gas are repeated alternately several times to purge the semiconductor process gas out of the system.

After completion of the above purging operation, the exhaust valve 84*a* and the selector valve 85*a* are closed and opened respectively to allow the purge gas to flow out from the connecting section 62*a*, and also a purge gas is introduced into the gas cylinder unit 80*a* and is let flow out through the outlet valve 68*a*. In this state, the connecting section 62*a* is separated, and this prevents entry of the ambient air into the system to cause contamination therein.

Further, another gas cylinder unit 80*a* is connected to the connecting section 62*a* under outflow of the purge gas from each side thereof. Subsequently, the exhaust valve 84*a* and the selector valve 85*a* are opened and closed interchangeably to effect purging in the system in the same manner as described above, and then the purge gas inlet valve 53 and the exhaust valve 84 are closed to introduce the purge gas from the gas cylinder unit 80*a* side and effect purging by distributing the purge gas from the gas discharge unit 29 to the gas supply unit 50 in the same manner as described in the above embodiment. The gas used for the purging passes through the selector valve 85*a* and a detector 60 to be exhausted into the exhaust pipe 82.

Finally, the evacuation of the system and introduction and pressurization of the semiconductor process gas are repeated in the same manner as described above, and the valves are closed after replacement of the gas in the system with the semiconductor process gas to allow the gas cylinder unit 80*a* to assume a standby posture.

Replacement of the gas cylinder unit 80*b* can be implemented by operating an outlet valve 68*b*, an exhaust valve 84*b* and a selector valve 85*b* all communicating to the connecting section 62*b* in the same manner as described above. Thus, a clean semiconductor process gas can be supplied to a semiconductor processing apparatus stably and continuously.

Further, it is also possible to arrange three or more gas cylinder connecting sections to supply a semiconductor process gas from two or more systems simultaneously, thus coping easily with mass-supply of the semiconductor process gas.

Incidentally, an inlet valve is preferably attached to the gas supply unit 50 side when the connecting sections are kept detached from the gas cylinder units for a long time. However, in the case where replacement of the gas cylinder unit can be implemented in a short time under outflow of the purge gas, the inlet valve can be omitted as shown in FIG. 9. Meanwhile, in the case where the system can be purged well with distribution of a purge gas from the gas cylinder unit side, the purge gas inlet channel on the supply unit side can be omitted. It should be noted here that by stacking two gas cylinder units 80*a* and 80*b* containing gas cylinders 21*a* and 21*b* each charged, for example, with 100 kg of $SiH_4$ (monosilane), the footprint of the gas supply apparatus is reduced to about as half as much as the footprint (5 $m^2$) of the conventional bundled system gas supply apparatus.

What is claimed is:

1. An apparatus for supplying a semiconductor process gas charged in a large-capacity gas vessel to a plant where the gas is used, after reduction of the pressure of the gas, wherein the gas vessel comprises a cylindrical portion and hemispherical portions formed at ends of the cylindrical portion respectively and also has a gas charge port at one hemispherical portion and a gas discharge port at the other hemispherical portion, both of the ports opening in alignment with the axis of the cylindrical portion;

a charge valve and a gas discharge unit having at least a gas vessel valve and a pressure reducing valve being connected to the gas charge port and the gas discharge port respectively;

the gas vessel being housed together with the charge valve and the gas discharge unit in a container.

2. The apparatus for mass-supplying a semiconductor process gas according to claim 1, wherein the gas discharge unit has a plurality of pressure reducing valves arranged in series.

3. The apparatus for mass-supplying a semiconductor process gas according to claim 1, further comprising at least one selected from an alarm for detecting gas leakage in the container; exhaust means for exhausting the gas in the container; and a purge gas vessel charged with a purge gas for effecting purging in the gas discharge unit.

4. The apparatus for mass-supplying a semiconductor process gas according to claim 1, wherein a gas supply unit is connected to the gas discharge unit outside the container; the gas supply unit containing a supply valve connected to a piping of the plant where the gas is used, a purge gas inlet passage and an analysis gas outlet passage connected to the upstream side of the supply valve.

5. The apparatus for mass-supplying a semiconductor process gas according to claim 4, further comprising at least one selected from a detector for analyzing impurities contained in a gas to be purged out when the gas discharge unit is connected to the gas supply unit; and a detoxicating column for detoxicating the gas to be exhausted by the purging before the gas discharge unit is spearated from the gas supply unit.

6. The apparatus for mass-supplying a semiconductor process gas according to claim 1, wherein a plurality of containers are selectively connected to one gas supply unit.

* * * * *